US006705182B2

(12) United States Patent
Bennett

(10) Patent No.: US 6,705,182 B2
(45) Date of Patent: Mar. 16, 2004

(54) WRENCH FOR JUMPER MECHANICALS

(76) Inventor: William Lamon Bennett, P.O. Box 13, Whitesboro, TX (US) 76273

( * ) Notice: Subject to any disclaimer, the term of this patent is extended or adjusted under 35 U.S.C. 154(b) by 0 days.

(21) Appl. No.: 09/754,628

(22) Filed: Jan. 4, 2001

(65) Prior Publication Data

US 2002/0083800 A1 Jul. 4, 2002

(51) Int. Cl.[7] ..... B25B 13/48
(52) U.S. Cl. ..... 81/176.2; 81/186
(58) Field of Search ..... 81/176.1, 176.15, 81/176.2, 176.3, 119, 186

(56) References Cited

U.S. PATENT DOCUMENTS

| | | | | | |
|---|---|---|---|---|---|
| 463,137 | A | | 11/1891 | Carpenter | |
| 1,504,847 | A | * | 8/1924 | Tarr | 81/176.3 |
| 1,527,772 | A | * | 2/1925 | Baird | 81/176.1 |
| 1,624,508 | A | | 4/1927 | Reilly | |
| 1,763,353 | A | * | 6/1930 | Heller | 81/176.1 |
| 1,936,359 | A | * | 11/1933 | Huthsing et al. | 81/176.1 |
| 1,945,406 | A | * | 1/1934 | Adams | 81/119 |
| 2,334,069 | A | | 11/1943 | Collins | |
| D138,515 | S | * | 8/1944 | Hardy | 81/176.1 |
| 3,292,465 | A | * | 12/1966 | Mulligan | 81/176.3 |
| 3,875,828 | A | | 4/1975 | Evans | |
| 3,921,476 | A | | 11/1975 | Evans | |
| 4,013,313 | A | * | 3/1977 | Gardels | 81/176.1 |
| 4,244,559 | A | * | 1/1981 | Mote | 81/176.1 |
| 4,688,454 | A | | 8/1987 | Scull | |
| 4,774,862 | A | | 10/1988 | Scull | |
| 5,247,715 | A | * | 9/1993 | Nishiguchi | 81/176.15 |

FOREIGN PATENT DOCUMENTS

| | | | | |
|---|---|---|---|---|
| IT | 265335 | * | 6/1929 | 81/176.1 |

* cited by examiner

*Primary Examiner*—James G. Smith
(74) *Attorney, Agent, or Firm*—Conley Rose, P.C.

(57) ABSTRACT

A wrench used to tighten and loosen mechanicals on electrical jumper cables without damaging the mechanical. The innovative tool includes a head portion having first and second work surfaces for engaging a mechanical's grip, said first and second work surfaces arranged about an imaginary axis of rotation and substantially parallel to said axis, and a handle secured to the head for allowing manual manipulation of the present invention so as to cause the mechanical grip to rotate. When the innovative wrench head is turned in a predetermined direction, the two work surfaces provide substantial surface-to-surface contact with the mechanical grip being turned, thereby increasing rotational torque while reducing grip deformation and damage.

19 Claims, 8 Drawing Sheets

PRIOR ART FIG. 1B

PRIOR ART FIG. 1C

PRIOR ART 1A

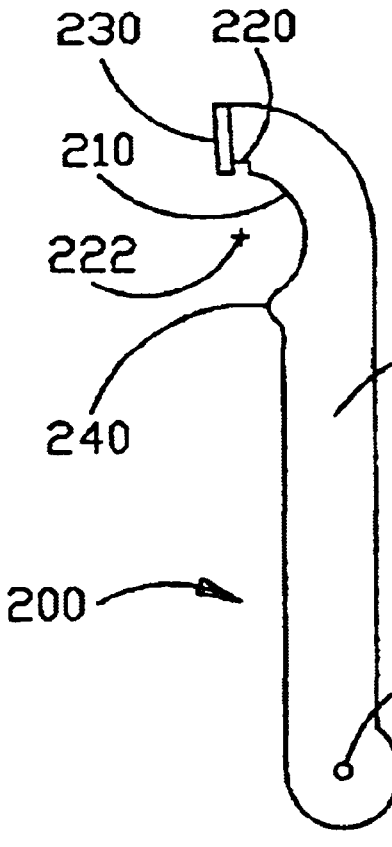
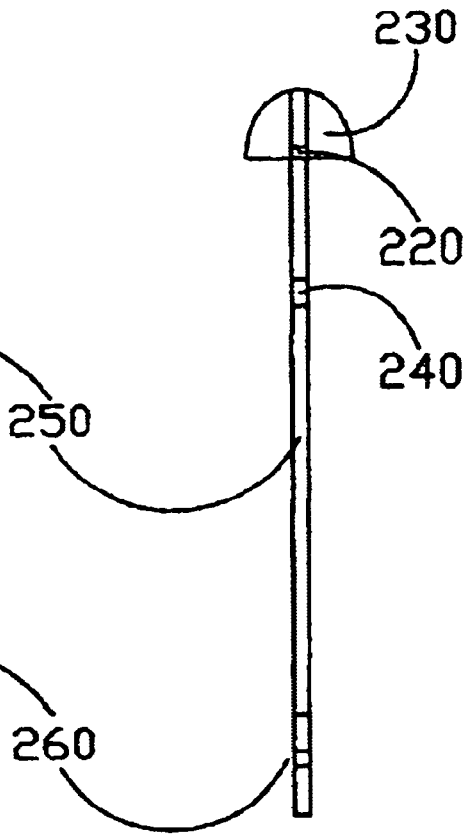
FIG. 2A FIG. 2B
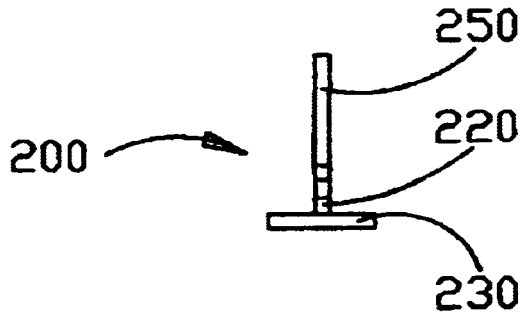
FIG. 2C

WRENCH FOR JUMPER MECHANICALS

FIELD OF THE INVENTION

This invention relates to hand tools for manipulating electrical connectors and, more particularly, to a wrench for turning a mechanical grip for a jumper clamp.

BACKGROUND

Background: Electrical Distribution Line Construction Maintenance and Repair

Commonly, an electrical distribution system uses three-phase alternating current (AC) electricity to transmit electrical energy from a generating source to a consumer. Each phase is transmitted over a separate distribution line. Each distribution line is electrically isolated from the other two in order to avoid a short circuit, which would create a potentially hazardous over-current condition.

During the construction, maintenance or repair of electrical distribution lines, it is often desirable and necessary to provide uninterrupted electrical service to a utility's customers. In order to provide uninterrupted service, a method of re-routing electricity around breaks in distribution lines must be used.

A common method of re-routing practiced by linemen in utility maintenance crews is to use a series of jumper wires to reroute the electricity. Either the lineman will climb a utility pole to get to the distribution lines or a bucket truck will lift the lineman up to the distribution lines. The utility lineman will attach one end of the jumper wire to a distribution line, upstream of a switch. The lineman then connects the other end of the jumper wire to another section of distribution line such that the jumper wire, in conjunction with the downstream switch, will electrically bypass the region of distribution line on which the lineman wishes to work. By using a separate jumper wire for each phase, the lineman can re-route all three phases so that uninterrupted electrical service is provided to the utility's consumers even while the lineman make repairs of strings new distribution lines.

Background: Jumper Wire Mechanicals

Linemen use specialized jumper wires for electrical distribution lines. As shown in FIG. 1A, the jumper wires 50 typically consist of heavy gauge wire 60 with one heavy-duty connector 100 at each end. Linemen commonly refer to these connectors 100 as "mechanicals." A typical mechanical 100 is shown in FIGS. 1B and 1B'. The jumper wire 60 is usually encased in an electrically nonconductive rubber or plastic material, for example, but portions of the mechanical 100 are bare metal.

Mechanicals 100 for the jumper wire 60 are designed to be tightened by hand, and indeed, that is how linemen presently attach them to distribution lines. As shown in FIG. 1B, the typical mechanical 100 has two main components, a metal hook 110 and a grip 120 made of an electrically non-conductive material, for example, plastic. A tail portion 115 of the hook 110 extends into the grip 120 and is connected to the jumper wire 60. The tail portion 115 is threaded. The inner surface of the grip 120 is threaded so that the grip 120 will travel along the threads of the tail 115 as grip 120 is turned. Metal washer 130 moves in relation to hook 110 as grip 120 is turned. As the metal washer 130 moves towards the hook 110, electric distribution line 150 is compressed between washer 130 and hook 110. Grip 120 has a plurality (usually two diametrically opposed) of raised ridges 140 disposed on its periphery that run the length of the grip. Ridges 140 allow the lineman to grasp the mechanical 100 securely and get leverage to turn the grip 120. Typically, the grip 120 is threaded on its inner surface so that it will easily travel along the threads of the tail 115. The hook 110 has matching threads so that the grip 120 will move either closer to, or further from, the hook 110 as the grip is rotated. Although the lineman wears rubber gloves, flange 155 reduces the possibility of contact between the lineman's hand and the metal hook 110, distribution line 150, or washer 130. Ideally, the lineman causes the hook 110 to firmly hold a distribution line by rotating the grip such that the distribution line 150 is compressed between hook 110 and washer 130.

FIGS. 1C and 1C' show a common variation of the jumper mechanical. In this variation, a plurality of protrusions 160 allow the lineman to graph and rotate the grip. The protrusions 160 are typically block-shaped and arranged longitudinally in parallel rows.

Background: Effects of Loose Electrical Connection

No matter how tightly a lineman may tighten a jumper mechanical by hand, it will often loosen due to forces beyond the lineman's control such as wind shaking the distribution lines, or contraction and expansion of the mechanical due to variations in weather. The effects of a loose connection to a distribution line can be catastrophic. Because electrical distribution lines carry high voltages, loose connections to distribution lines can cause dangerous electrical arcing which may bum the lineman or cause interruption of electrical service. High temperatures due to the increased electrical resistance across the loose connection can result in hazardous fires that may end in loss of property or life. Mechanicals and jumpers often are melted completely through by the extreme heat caused by a loose connection. The dangling remnants of the jumper often touch other distribution lines causing a direct short circuit between different phases and a sudden power outage due to the current rush through the short circuit. If the jumper touches television cables or telephone lines, it may also cause damage to many televisions and phones and harm persons using them.

Background: Wrenches

A wrench is a type of tool commonly used to hold or apply rotational force to nuts, bolts, and pipes. Familiar types of wrenches are the open-ended wrench, the monkey wrench, and the Stillson (pipe) wrench. Hundreds of different wrenches have been awarded United States patents, most of them for tools which are adapted to hold or rotate with work pieces with circular or polygonal cross sections.

For example, U.S. Pat. No. 463,137, awarded to Carpenter, discloses an open-end wrench having a jaw with a plurality of transverse notches. The edges of the transverse notches will engage adjacent linear faces of a polygonal nut. The notches allow the wrench to be rotated to obtain a fresh hold on the nut without removing the wrench from the nut.

For example, U.S. Pat. No. 1,624,508, awarded to Reilly, discloses an open-end, fixed jaw wrench which can hold nuts and bolts of various sizes. The wrench of Reilly has one jaw with a smooth face and an opposite jaw with a stepped face. The steps are sized so that the jaws will engage the flat faces of various sizes of polygonal nuts.

For example, U.S. Pat. No. 2,334,069, awarded to Collins, et al., discloses an open end wrench designed to turn coupling nuts for joining hoses such as fire hoses or oil hoses. This wrench is intended to be used with three general types of coupling nut, all of which have diametrically opposed pegs (lugs). The head of the wrench has a cavity that fits over one peg on the coupling nut. In addition to engaging one peg, the wrench has a working face that engages the perimeter of the coupling nut somewhere between the two pegs.

Prior inventions appear to have focused almost exclusively on wrenches which can hold or rotate nuts, bolts, or pipes. There has been a conspicuous lack of wrenches created to accommodate work pieces which have protruding features. In particular, there has not been an adequate wrench designed to manipulate jumper mechanicals.

SUMMARY OF INVENTION

One or more of the disclosed embodiments provides at least the following advantage: a tool for improved manipulation of jumper mechanicals.

One or more of the disclosed embodiments provides at least the following advantage: a tool that will work with many different jumper mechanical grips.

One or more of the disclosed embodiments provides at least the following advantage: a tool that may be used easily and safely in the confines of a bucket truck.

One or more of the disclosed embodiments provides at least the following advantage: a tool that can apply rotational force to two diametrically opposed features, such as longitudinal ridges, on a mechanical grip.

One or more of the disclosed embodiments provides at least the following advantage: a tool that can spread rotational force along a substantial portion of a longitudinal feature that runs parallel to the axis of rotation, such as a ridge, on a mechanical grip.

In the presently preferred embodiment of the invention, a tool has a cut-out which will engage the grip of a jumper mechanical. The cut-out has a notch that fits over a first ridge on the mechanical grip. A plate engages the first ridge so that rotating the handle of the tool about the longitudinal axis of the mechanical's grip will cause the grip to travel along the threads of the tail portion of the hooks. The plate spreads the rotational force along the length of the ridge, parallel to the axis of rotation, rather than concentrating it in one area. The plate may be a semicircle, rectangle, or any suitable shape. The increased force provided by the tightening tool creates a more secure jumper connection which may be less susceptible to failure and arcing.

If the grip has a second ridge, a knob on the handle may engage the second ridge such that the knob may push against the second ridge as the handle of the tool is rotated about the longitudinal axis of the mechanical's grip, providing increased leverage for tightening the mechanical.

BRIEF DESCRIPTION OF THE DRAWINGS

The disclosed inventions will be described with reference to the accompanying drawings, which show important sample embodiments of the invention and which are incorporated in the specification hereof by reference, wherein:

FIG. 1B' depicts a top view of a first prior art jumper mechanical.

FIG. 1C'depicts a top view of a second prior art jumper mechanical.

FIG. 2A depicts a side-view of the presently preferred embodiment of the innovative tool.

FIG. 2B depicts a top view of the presently preferred embodiment of the innovative tool.

FIG. 2C depicts a front-view of the presently preferred embodiment of the innovative tool.

DETAILED DESCRIPTION OF THE PREFERRED EMBODIMENTS

Figure 1B:
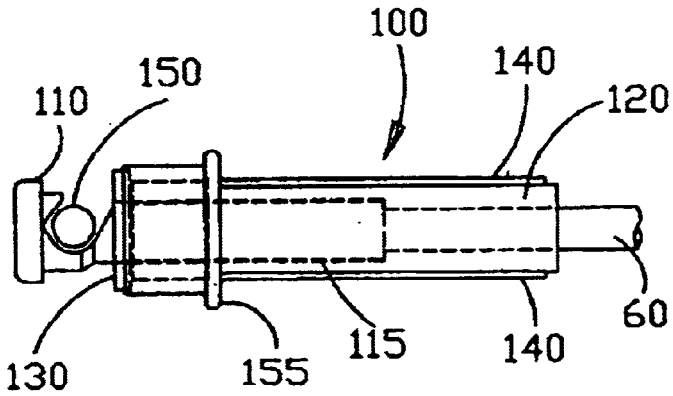
FIG. 1B depicts a side view of a first prior art jumper mechanical.
Figure 1B:
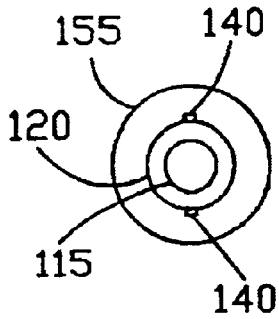

The numerous innovative teachings of the present application will be described with particular reference to the presently preferred embodiment. However, it should be understood that this class of embodiments provides only a few examples of the many advantageous uses of the innovative teachings herein. In general, statements made in the specification of the present application do not necessarily delimit any of the various claimed inventions. Moreover, some statements may apply to some inventive features but not to others.

A tool having an open-end wrench head is described. In some embodiments, the wrench head has two principle internal engaging surfaces arranged about an imaginary central axis of rotation. In the preferred embodiment discussed below, the first internal engaging surface is substantially flat and parallel to the imaginary central axis. In some embodiments, the second internal engaging surface is curved and when engaged with the workpiece is tangent to a ridge on the workpiece. The "principle" internal engaging surfaces are the internal engaging surfaces of the wrench head which are of the greatest importance and which actually engage and interact with the workpiece (for example, the mechanical grip) under torque, during normal operation of the tool.

The presently preferred embodiment of the disclosed innovative tool is shown in FIGS. 2A–D. In the preferred embodiment, the tool 200 has a cut-out 210 designed to engage the grip 275 of a jumper mechanical 270. The cut-out 210 has a notch 220 designed to engage the first ridge 280 on the mechanical's grip 275. A plate 230 (first internal engaging surface) completes one side of the notch 220. At the other side of the cut-out 210, a knob 240 (second internal engaging surface) can engage a second ridge 285 on the mechanical grip 275. The lineman uses the tool 200 by engaging it with the grip 275 of the mechanical 270, grasping the handle 250 and rotating the tool 200 about the central (longitudinal) axis 290 of the jumper mechanical 270. When the tool 200 is engaged with the mechanical, the axis 290 corresponds with the imaginary axis of rotation 222 of the tool. As the tool 200 is rotated about axis 222, the plate 230 engages the first ridge 280 of the grip 275, spreading the rotational force along the ridge 280 and causing the grip 275 to rotate. By spreading the force along the ridge 280, potential for damage to the ridge 280 by the rotational force and potential for slippage of the tool are reduced.

Optionally, the tool 200 may have a hole 260 at the opposite end of the handle 250 from the cut-out 210. The hole 260 may be used to hang the tool 200 from a hook on a lineman's belt, or in a utility truck bucket, when the tool 200 is not in use.

Alternative Embodiments

Figures 3A, 3B:
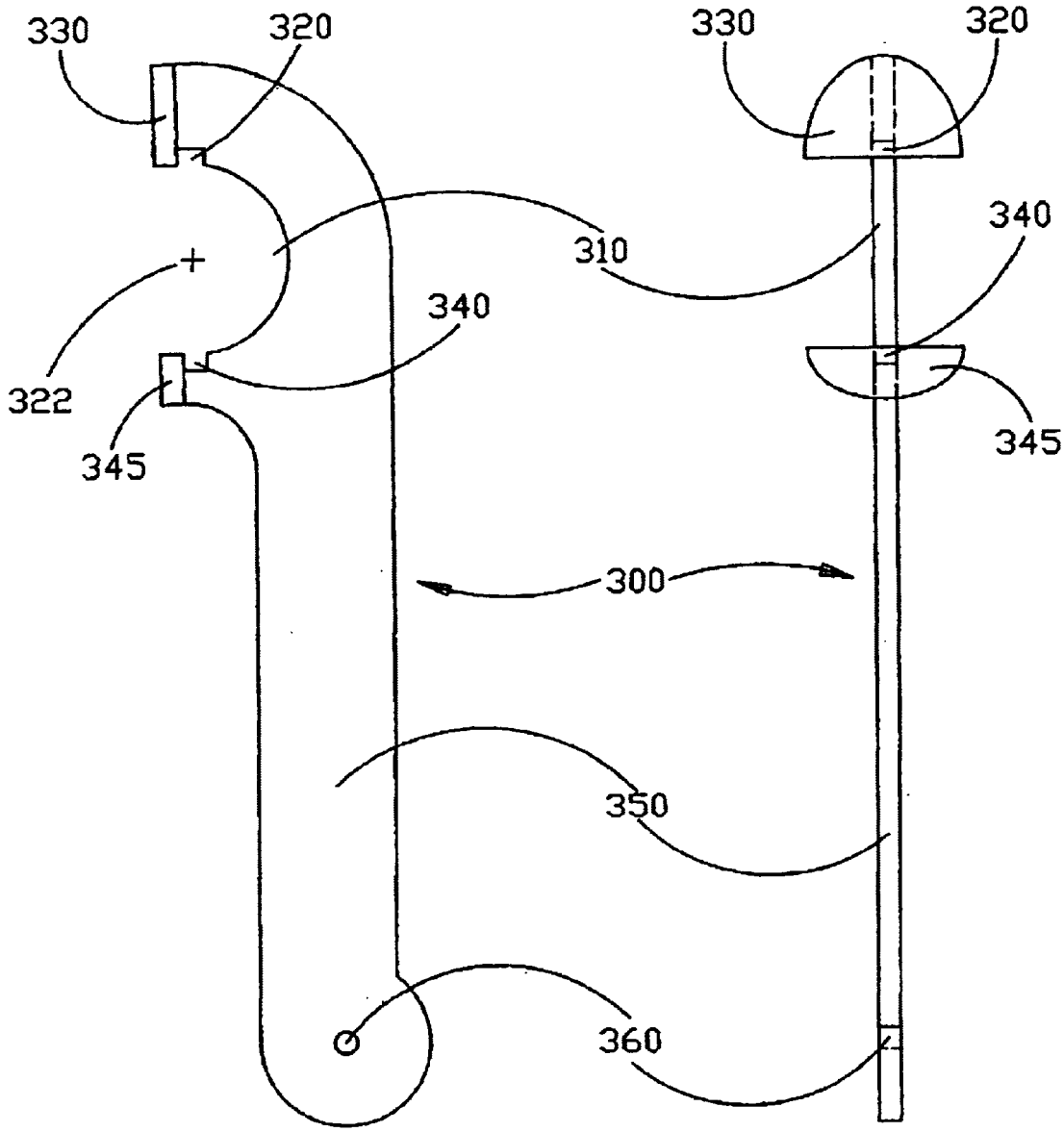
FIG. 3A depicts a side-view of a first alternative embodiment of the innovative tool.
FIG. 3B depicts a top-view of the first alternative embodiment of the innovative tool.
Figure 3C:
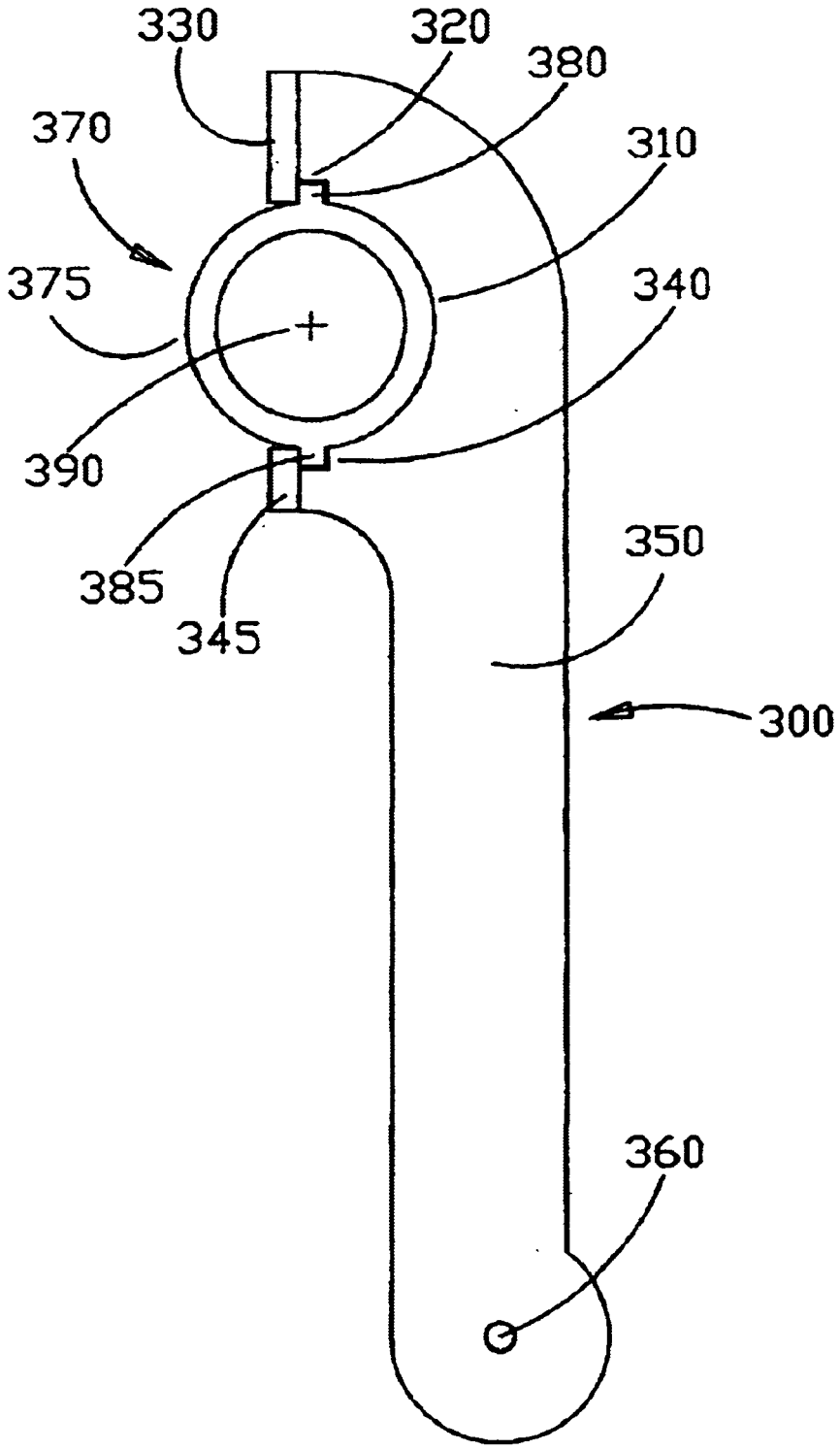
FIG. 3C depicts the first alternative embodiment engaging a first prior art jumper mechanical.

FIGS. 3A–C show views of a first alternative embodiment of the innovative tool. This embodiment has a plurality of plates and notches. In the first alternative embodiment, the tool 300 has a cut-out 310 that engages the grip 375 of a jumper mechanical 370. The cut-out 310 has a first notch 320 that fits over the first ridge 380 on the mechanical's grip 375. A first plate 330 completes one side of the first notch 320. At the other side of the cut-out 310, a second notch 340 fits over a second ridge 385 on the mechanical grip 375. A second plate 345 completes one side of the second notch 340. The lineman uses the tool 300 by engaging it with the grip 375 of the mechanical 370, grasping the handle 350 and rotating the tool 300 about the central (longitudinal) axis 390 of the jumper mechanical 370. As the tool 300 is rotated about imaginary axis of rotation 322, a plate (330 or 345) will engage its corresponding ridge (380 or 385) and cause the grip 375 to rotate.

Due to the second plate 345 that allows rotational force to be exerted against the second ridge 385, an additional advantage of this first alternative embodiment is that the tool 300 can be used to tighten or loosen the mechanical 370 without removing the tool from the workpiece. However, due to the second plate, this first alternative embodiment may have to be engaged with some mechanical grips by first placing the cut-out over the jumper wire and then sliding the cut-out onto the mechanical grip.

Optionally, the tool 300 may have a hole 360 at the opposite end of the handle 350 from the cut-out 310. The hole 360 is used to hang the tool 300 from a hook on a lineman's belt, or in a utility truck bucket, when the tool 300 is not in use. Alternatively, a keyring may be used in conjunction with the hole 360.

Figure 1C:
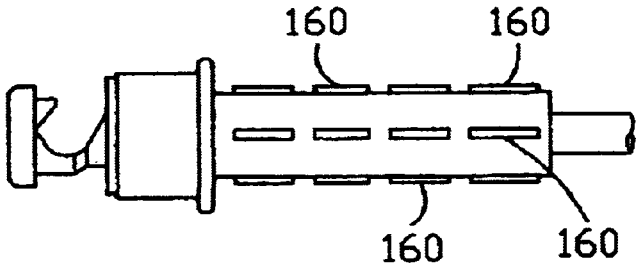
FIG. 1C depicts a side view of a second prior art jumper mechanical.
Figure 1C:
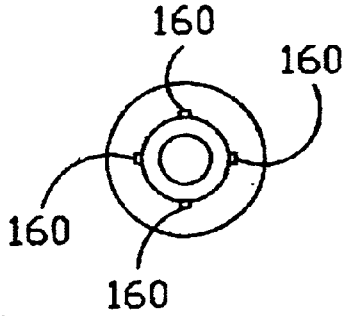
Figure 1A:
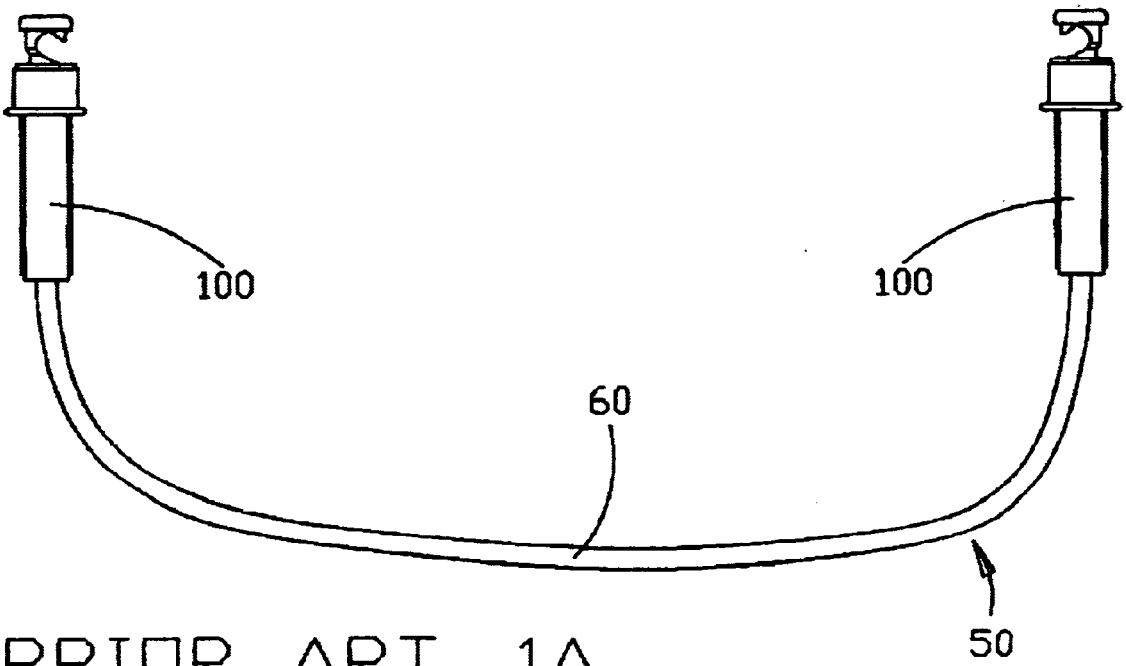
FIG. 1A depicts a prior art jumper, with mechanicals at both ends.
Figure 2D:
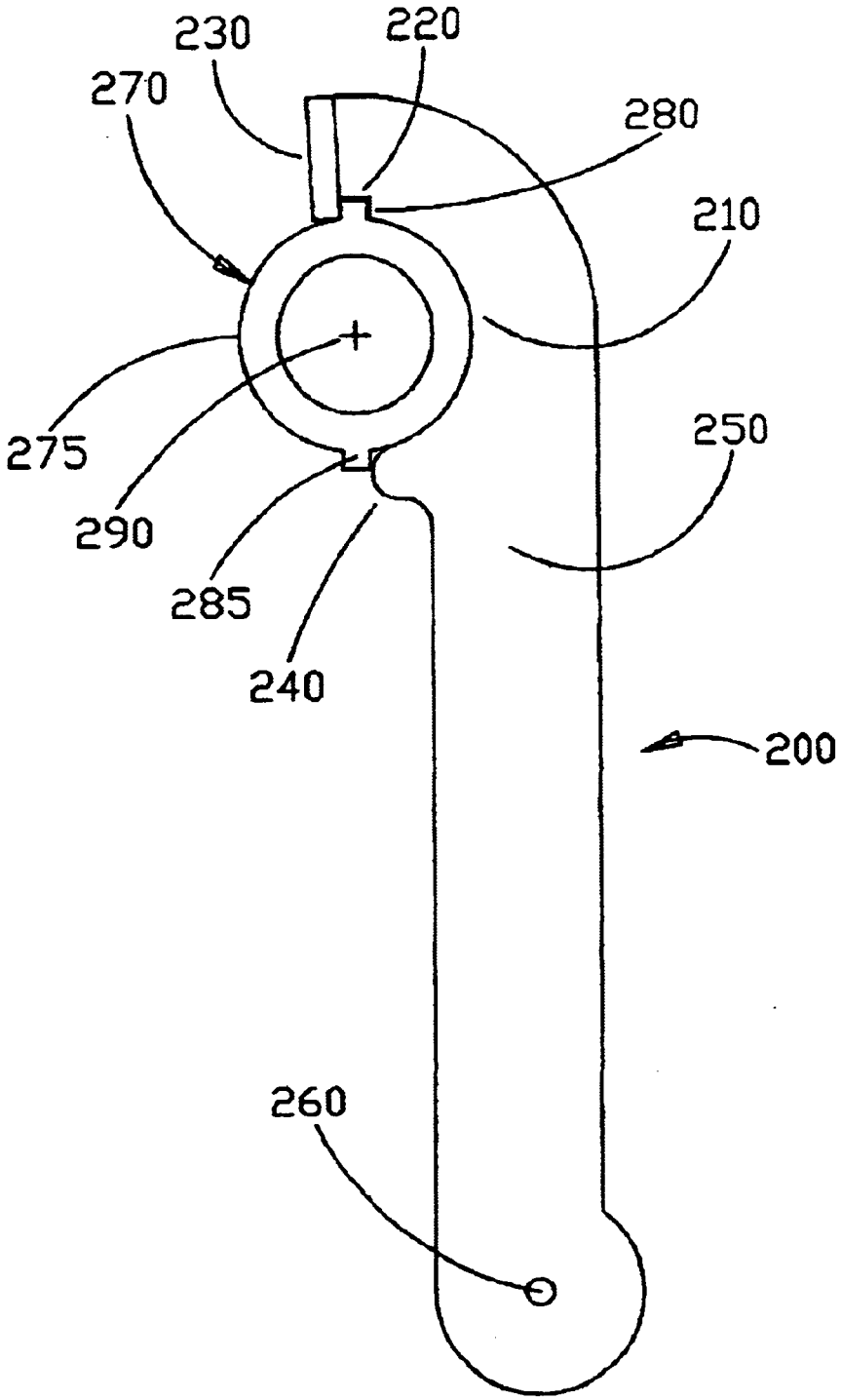
FIG. 2D shows the presently preferred embodiment of the innovative tool engaging a first prior art jumper mechanical.
Figure 4A:
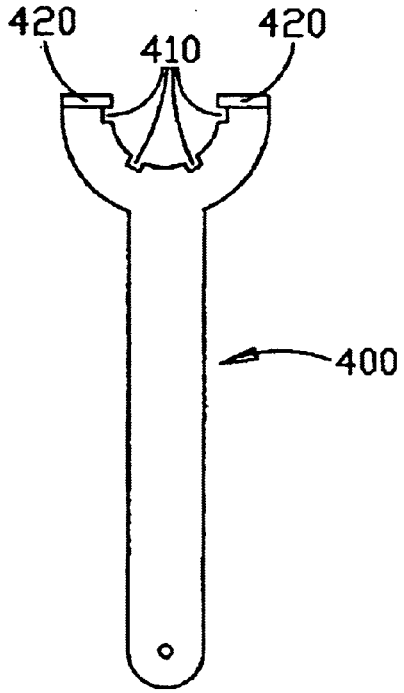
FIG. 4A depicts a side-view of a second alternative embodiment of the innovative tool.

FIG. 4A shows a second alternative embodiment of the innovative tool. In this second alternative embodiment, the tool 400 has a plurality of notches 410 and plates 420. The plurality of notches and plates are useful for engaging mechanical grips with a plurality of ridges or rows of protuberances 160, such as the second prior art grip, as shown in FIG. 1C. This embodiment also illustrates the principle that placement and shape of the handle can vary in different embodiments of the tool.

Figure 5A:
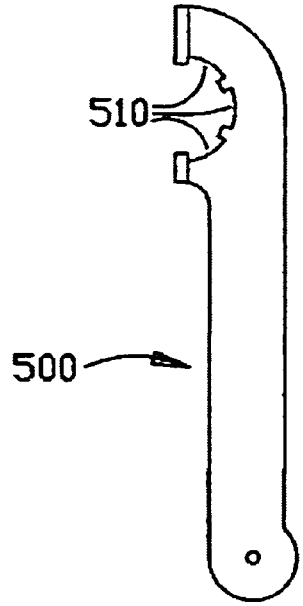
FIG. 5A depicts a side-view of the third alternative embodiment of the innovative tool.

FIG. 5A shows a third alternative embodiment of the innovative tool. In this third alternative embodiment, the tool 500 has a plurality of notches 510 that are much wider than those shown in the previous embodiments. This embodiment illustrates that the width of the notch can be varied in different embodiments of the tool.

Figures 6A, 6B:
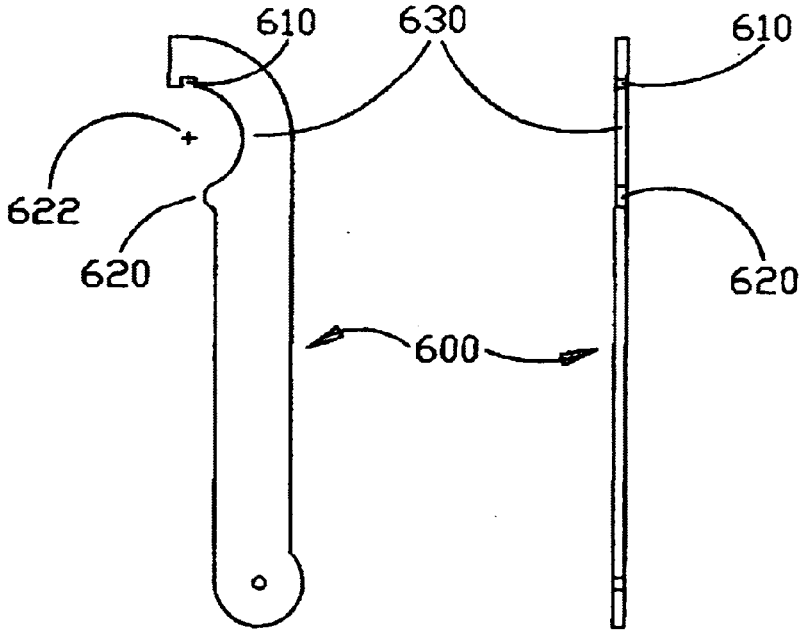
FIG. 6A depicts a side-view of a fourth alternative embodiment of the innovative tool.
FIG. 6B depicts a top-view of the fourth alternative embodiment of the innovative tool.

FIGS. 6A–B show a fourth alternative embodiment of the innovative tool. In this fourth alternative embodiment, the tool 600 has a notch 610 and a knob 620 but does not have a plate like the embodiments discussed above. This embodiment is easier to manufacture than embodiments that have plates. It works best on grips that have ridges rather than grips that have rows of protrusions. As in the other disclosed embodiments, the imaginary axis of rotation 622 of tool 600 is disposed within the cut-out 630. Because there is no plate to spread the rotational force along the grip's ridge as in the other embodiments discussed above, this embodiment may have a higher risk of damaging the ridge when excessive torque is applied. This embodiment illustrates that a plate is not necessary in all embodiments of the invention.

Figure 7A:
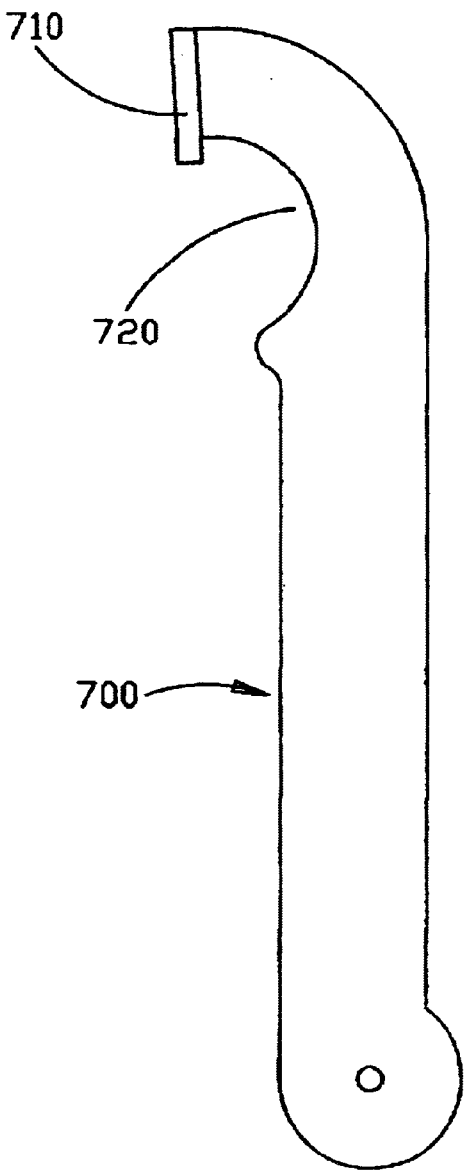
FIG. 7A depicts a side-view of a fifth alternative embodiment of the innovative tool.

FIG. 7A shows a fifth alternative embodiment of the innovative tool. In this fifth alternative embodiment, the tool 700 has a plate 710 but no notch, unlike the embodiments discussed above. The plate 710 protrudes into the cut-out 720. As the tool 700 is turned, the plate 710 will engage a feature such as a ridge on the grip of the mechanical, causing the grip to rotate. This fifth alternative embodiment illustrates that a notch is not necessary in all embodiments of the invention.

Figure 8A:
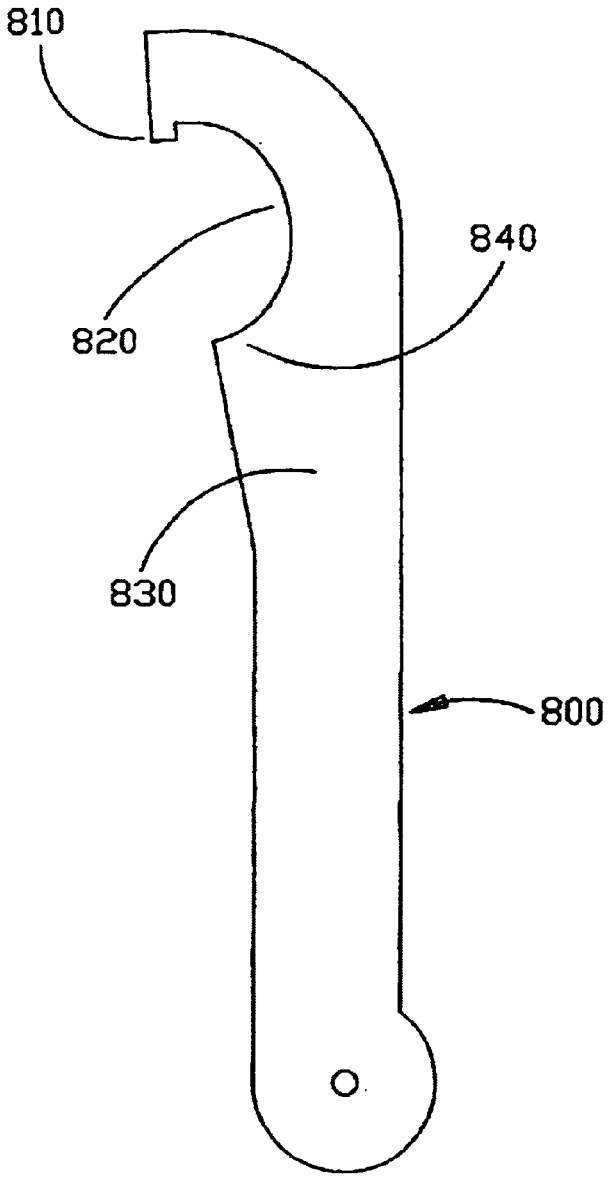
FIG. 8A depicts a side-view of a sixth alternative embodiment of the innovative tool.

FIG. 8A shows a sixth alternative embodiment of the innovative tool. In this sixth alternative embodiment, neither a plate nor a knob are present. The sixth alternative embodiment of the innovative tool 800 has a tooth 810 that protrudes into cut-out 820. The tooth 810 can be engaged with a feature such as a ridge on a workpiece such as a mechanical grip. By rotating the handle 830 around the longitudinal axis of the workpiece, the tooth 810 will transfer rotational force from the tool 800 to the workpiece. If the workpiece has a second ridge such as the grip shown in FIG. 1B, the intersection point 840 of the cut-out and the handle may engage the second ridge and aid in the transfer of rotational force from the tool 800 to the workpiece.

Figures 9A, 9B:
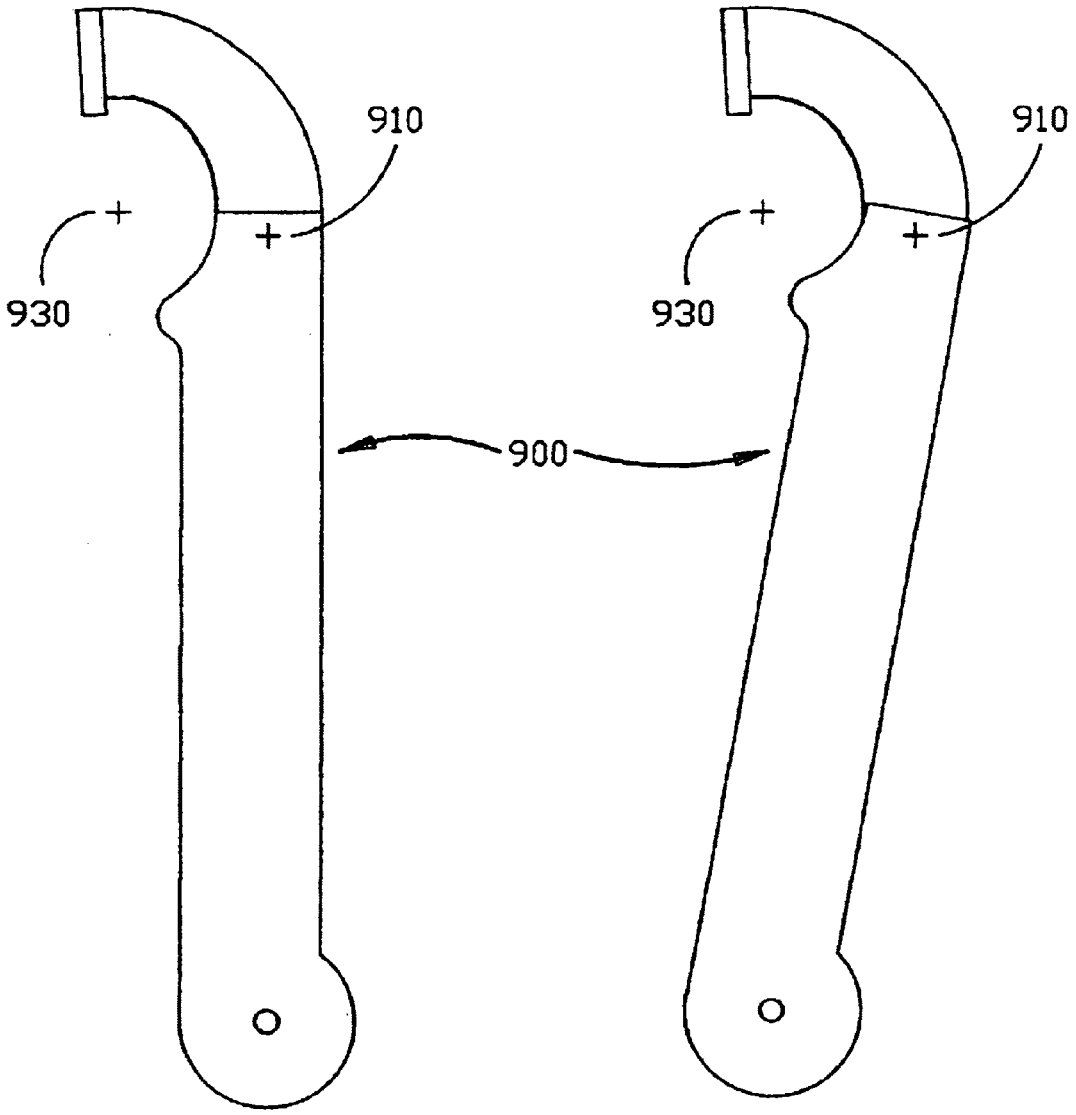
FIG. 9A depicts a side-view of a seventh alternative (hinged) embodiment of the innovative tool.
FIG. 9B depicts a side-view of the seventh (hinged) alternative embodiment of the innovative tool with the handle partially rotated about the pivot point (hinge axis).

FIGS. 9A and 9B show a seventh alternative embodiment of the innovative tool. The seventh alternative embodiment of the innovative tool 900 has a pivot point 910 in the head, which allows the tool to adjust to a variety of mechanical grips having different diameters. In the preferred embodiment of this alternative, the pivot point is a hinge having an axis of rotation substantially parallel the imaginary axis of rotation 930 of the tool 900. FIG. 9B discloses the tool 900 with the handle 920 partially rotated around the pivot point According to a disclosed class of alternative embodiments the innovative tool may be applicable for use with work pieces other than mechanical grips. For instance, embodiments of the innovative tool may be applicable for use with certain nuts (such as wing nuts), bolts, connectors, or fasteners.

Modifications and Variations

As will be recognized by those skilled in the art, the innovative concepts described in the present application can be modified and varied over a tremendous range of applications, and accordingly the scope of patented subject matter is not limited by any of the specific exemplary teachings given.

For example, the number and width of the notches in the cut-out can be varied.

For example, the position, shape, and length of the handle can be varied.

For example, although single-headed embodiments of the innovative tool are shown, embodiments with a head at each end of the handle are also possible.

For example, the shape and size of the plates for engaging the features on the mechanical grip can be varied.

For example, the plates for engaging the features on the mechanical grip can be manufactured integral to the head if the tool is cast from plastic or metal.

For example, the shape and size of the notches for engaging the features on the mechanical grip can be varied.

For example, some embodiments of the tool do not incorporate a knob in the handle, as shown in FIG. 8A. As a further example, some less preferred embodiments of the tool do not incorporate a notch in the cut-out, as shown in FIG. 7A and FIG. 8A. Some less preferred embodiments of the tool do not incorporate a plate, as shown in FIG. 6A and FIG. 6B.

Additional general background, which helps to show the knowledge of those skilled in the art regarding the invention's context, and of variations for mechanical grips, may be found in the following: the Hubbell/Chance Tool Catalog; the Reliable Equipment Power Utility Tool Guide; the W.H. Salisbury Line Equipment Catalog; and the Hastings Hot Line Tools & Equipment Catalog; all of which are hereby incorporated by reference.

What is claimed is:

1. A wrench for applying rotational force to a jumper mechanical without substantially damaging the jumper mechanical, comprising:

a handle;

a head coupled to said handle, said head having a cutout forming an internal engaging surface;

a plate coupled to said head, said plate having a width substantially greater than the width of the head and oriented such that a plane of said plate is substantially orthogonal to the direction of rotational force.

2. The wrench of claim 1, wherein said plate is coupled to said head in a position substantially orthogonal to said internal engaging surface.

3. The wrench of claim 1, wherein said internal engaging surface of said cutout extends, in a direction from the central longitudinal axis of the handle, to a point where said plate is at an angle relative to the central longitudinal axis of said handle of the tool when the plate is coupled in a position substantially orthogonal to the internal engaging surface of said cutout.

4. The wrench of claim 1, wherein said head has a notch shaped to engage a protrusion from a surface of a jumper mechanical.

5. The wrench of claim 4, wherein said plate forms a portion of said notch by completing one side of said notch.

6. The wrench of claim 4, wherein said notch engages a protrusion from the surface of a jumper mechanical, and transfers applied rotational force to the jumper mechanical via the protrusion, causing the jumper mechanical to rotate.

7. The wrench of claim 1, wherein said plate is oriented such that a plane of the plate is substantially orthogonal to the surface of the jumper mechanical when said wrench is engaged to said jumper mechanical.

8. The wrench of claim 1, further comprising a knob coupled to said head wherein part of the knob forms a portion of the internal engaging surface of the cutout.

9. The wrench of claim 1, wherein said handle is coupled to said head via a hinge, said hinge having an axis substantially parallel to the axis of rotational force.

10. The wrench of claim 1, wherein said plate has an engaging surface.

11. The wrench of claim 10, wherein the engaging surface of said plate is shaped so as to engage a jumper mechanical with substantially maximum surface area contact to minimize the risk of damaging said jumper mechanical.

12. The wrench of claim 1, wherein said plate is oriented to engage a jumper mechanical with substantially maximum surface area contact to minimize the risk of damaging said jumper mechanical.

13. A wrench for applying rotational force to a jumper mechanical without substantially damaging the jumper mechanical, comprising:

a handle means for rotating a jumper mechanical;

a head means for engaging a jumper mechanical coupled to said handle means, said head means having a cutout forming an internal engaging surface;

a plate means coupled to said head means and oriented such that a plane of the plate means is generally orthogonal to the direction of rotational force, and said plate means having an engaging surface substantially wider than the width of said head means.

14. The wrench of claim 13, further comprising at least one notch means, wherein said notch means is shaped to engage a protrusion from the surface of a jumper mechanical.

15. The wrench of claim 14, wherein a portion of said notch means is formed from said plate means.

16. The wrench of claim 13, wherein said notch means engages a protrusion from the surface of a jumper mechanical, and transfers applied rotational force to the jumper mechanical via the protrusion, causing the jumper mechanical to rotate.

17. The wrench of claim 13, wherein said plate is oriented such that a plane of the plate means is substantially orthogonal to the surface of the jumper mechanical when said wrench is engaged to said jumper mechanical.

18. The wrench of claim 13, further comprising knob means coupled to said head means wherein part of the knob means forms a portion of the internal engaging surface of the cutout.

19. The wrench of claim 13, further comprising hinge means joining said head means and said handle means, said hinge means having an axis substantially parallel to the axis of rotational force.

* * * * *